US008371667B2

(12) United States Patent
Yu et al.

(10) Patent No.: US 8,371,667 B2
(45) Date of Patent: Feb. 12, 2013

(54) SLIDE RAIL

(75) Inventors: Mo-Ming Yu, Shenzhen (CN); Ze-Hong Chen, Shenzhen (CN); Guang-Hua Gu, Shenzhen (CN)

(73) Assignees: Hong Fu Jin Precision Industry (ShenZhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 356 days.

(21) Appl. No.: 12/770,685

(22) Filed: Apr. 29, 2010

(65) Prior Publication Data

US 2011/0142383 A1 Jun. 16, 2011

(30) Foreign Application Priority Data

Dec. 16, 2009 (CN) ..... 2009 1 0311625

(51) Int. Cl.
*A47B 88/04* (2006.01)

(52) U.S. Cl. ..... 312/334.8

(58) Field of Classification Search ..... 312/330.1, 312/334.1, 334.7, 334.8, 334.14, 334.16, 312/334.22; 384/20, 22
See application file for complete search history.

(56) References Cited

U.S. PATENT DOCUMENTS 1,071,006 A * 8/1913 Little ..... 384/21
3,133,768 A * 5/1964 Klakovich ..... 384/17
6,805,418 B2 * 10/2004 Milligan ..... 312/333
6,834,923 B2 * 12/2004 Young et al. ..... 312/334.8
6,979,067 B2 * 12/2005 Yang ..... 312/334.46

* cited by examiner

*Primary Examiner* — James O Hansen
(74) *Attorney, Agent, or Firm* — Altis Law Group, Inc.

(57) ABSTRACT

A slide rail includes a first rail, a second rail, and a third rail. The first rail defines two recesses. The second rail forms two first sliding portions and two second sliding portions. The third rail defines two slide channels for slidably receiving the first sliding portions. The second sliding portions of the second rail are received in the recesses of the first rail.

20 Claims, 3 Drawing Sheets

SLIDE RAIL

TECHNICAL FIELD

The disclosure relates to slide rails and, particularly, to a slide rail without ball bearings.

DESCRIPTION OF RELATED ART

Slide rails are used for guiding objects, such as drawers, to be pushed into or pulled out from structures, such as furniture. There are many kinds of slide rails, some have ball bearings, and others do not. Slide rails having ball bearings are easy to be pulled or pushed, for they have little friction. However, the ball bearings add cost of the slide rails, and brackets for supporting the ball bearings tend to be broken, which causes the slide rails to become indurable. Slide rails without ball bearings have lower costs than those having ball bearings. However, such slide rails each have at least two slides movable relative to each other. The two slides contact each other in a line-contact mode. This kind of contact makes the slide rails unable to support heavy loads.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, all the views are schematic, and like reference numerals designate corresponding parts throughout the several views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Figure 1:
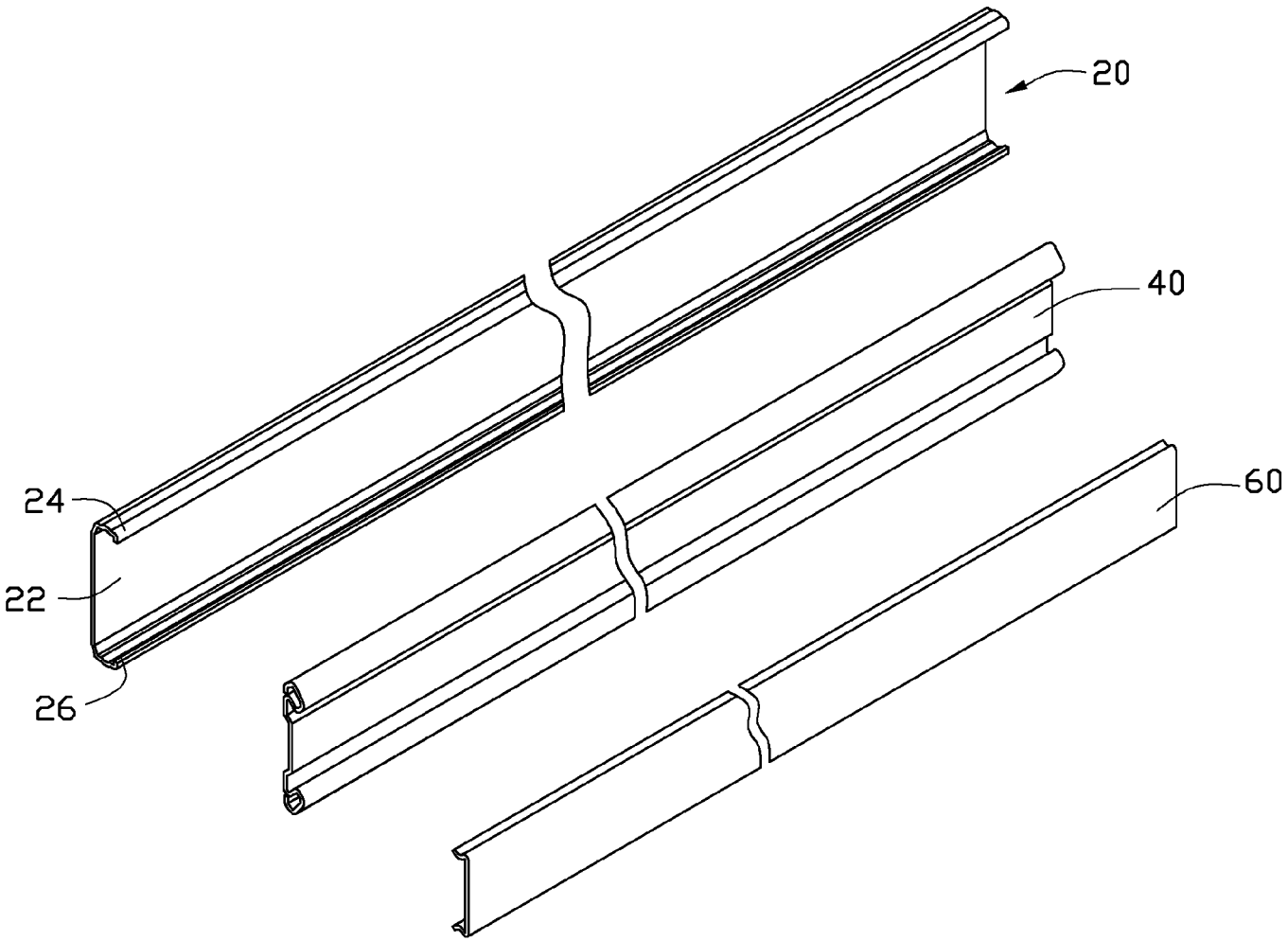
FIG. 1 is an exploded, isometric view of an exemplary embodiment of a slide rail.
Figure 2:
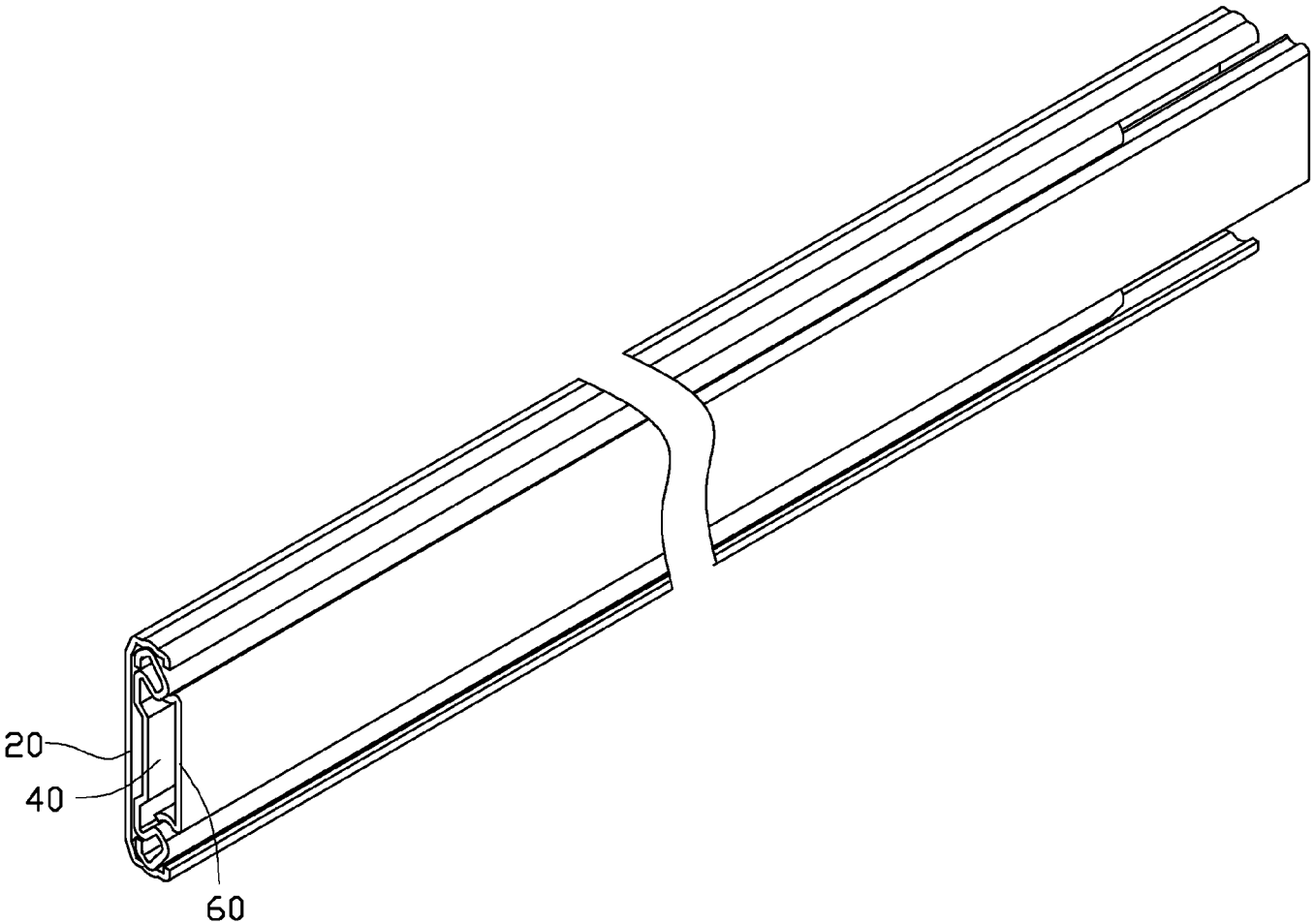
FIG. 2 is an assembled, isometric view of the slide rail of FIG. 1.

Referring to FIG. 1 and FIG. 2, an exemplary embodiment of a slide rail includes a first rail 20, a second rail 40, and a third rail 60. The first rail 20 is used for a base and is fixed on a stable object, like furniture, or a rack for a server. The third rail 60 can be fixed on a movable object, such as a drawer of the furniture, or the server to be installed in the rack. The second rail 40 is received in the first rail 20, and is installed between the first rail 20 and the third rail 60. The second rail 40 is movable relative to the first rail 20 and the third rail 60. Through the motion between the three slides, the movable object can be pushed into or can be pulled out from the stable object.

Figure 3:
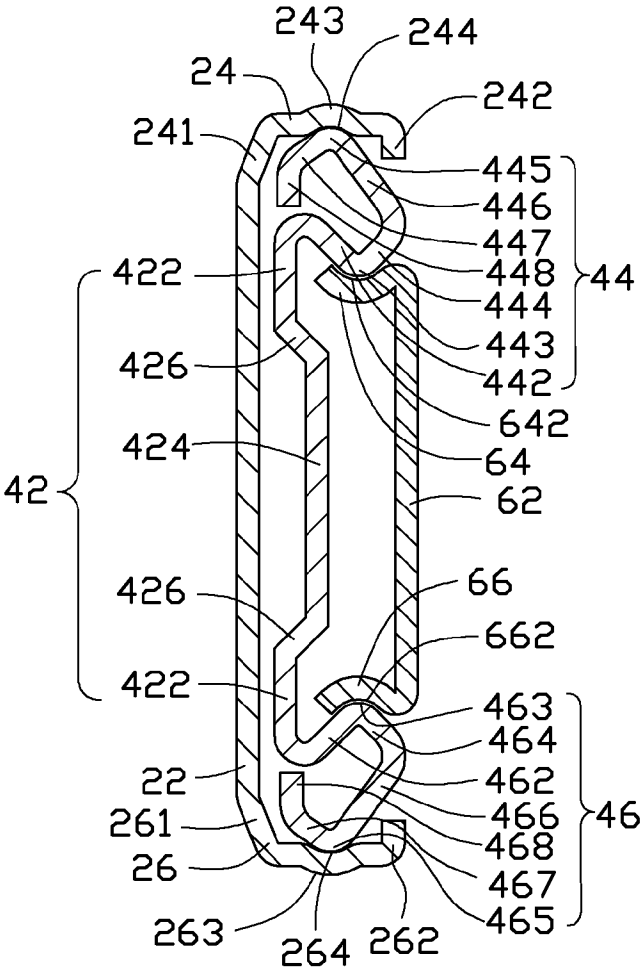
FIG. 3 is a cross-sectional view of the slide rail of FIG. 2.

Referring to FIG. 3, the first rail 20 includes a main wall 22, and two sidewalls 24 and 26 extending from opposite longitudinal sides of the main wall 22. Two inclined portions 241 and 261 are respectively formed from the two sidewalls 24 and 26 connect to the main wall 22. Distal ends 242 and 262 of the two sidewalls 24 and 26 are respectively deformed to be generally parallel with the main wall 22. Arc-shaped raised portions 243 and 263 are respectively extended outward from middle portions of the sidewalls 24 and 26. Thus at an inner side of each of the sidewalls 24 and 26, arc-shaped recesses 244 and 264 are defined respectively.

The second rail 40 includes a main body 42, and two side parts 44 and 46 integrally extending from opposite longitudinal sides of the main body 42.

The main body 42 includes two wing portions 422, a flat plate 424, and two connection portions 426. The wing portions 422 are disposed on two opposite sides of the flat plate 424, and are parallel with the flat plate 424, which is parallel with the main wall 22 of the first rail 20 after being assembled. The connection portions 426 are slantingly connected between the wing portions 422 and the sides of the flat plate 424. After assembly, the wing portions 422 are closer to the main wall 22 than the flat plate 424.

The side parts 44 and 46 have generally the same structure, so the side part 46 is mainly described in below description for simplicity. The side part 46 includes a first deformed portion 462, a second deformed portion 464, a third deformed portion 466, a fourth deformed portion 467, and a fifth deformed portion 468 connected in order. The first to fifth deformed portion 462, 464, 466, 467, and 468 to form a generally C shape. The first deformed portion 462 is acutely extended upward from a distal end of the corresponding wing portion 422, away from the first rail 20. The second deformed portion 464 is slantingly extended downward from a distal end of the first deformed portion 462, away from the first rail 20. An arc-shaped first sliding portion 463 is formed on an outer surface of a corner between the first deformed portion 462 and the second deformed portion 464. The third deformed portion 466 is slantingly extended downward from a distal end of the second deformed portion 464, towards the first rail 20. The fourth deformed portion 467 is slantingly extended upward from a distal end of the third deformed portion 466, towards the first rail 20. An arc-shaped second sliding portion 465 is formed on an outer surface of a corner between the third deformed portion 466 and the fourth deformed portion 467. The fifth deformed portion 468 is extended upward from a distal end of the fourth deformed portion 467, and is substantially parallel with the main wall 22 of the first rail 20. The curvature of the second sliding portion 465 is substantially the same as the curvature of the recess 264 of the first rail 20.

Similarly, the side part 44 includes a first deformed portion 442, a second deformed portion 444, a third deformed portion 446, a fourth deformed portion 447, and a fifth deformed portion 448 interconnect in order. A substantially arc-shaped first sliding portion 443 is formed on an outer surface of a corner between the first deformed portion 442 and the second deformed portion 444. A substantially arc-shaped second sliding portion 445 is formed on an outer surface of a corner between the third deformed portion 446 and the fourth deformed portion 447. The curvature of the second sliding portion 445 is the same as the curvature of the recess 244 of the first rail 20.

The third rail 60 includes an installation plate 62, and two curved portions 64 and 66 symmetrically disposed on two opposite longitudinal sides of the installation plate 62 respectively. The installation plate 62 can be fixed to the movable object when in use, and is substantially parallel with the main wall 22 of the first rail 20 after assembly. The curved portions 64 and 66 that have the symmetrical structure and are used for clamping the second rail 40 when assembled. An arc-shaped sliding channel 642 is defined in an outer surface of the curved portion 64. The sliding channel 642 has a same curvature as that of the first sliding portion 443 of the second rail 40. Similarly, an arc-shaped sliding channel 662 is defined in an outer surface of the curved portion 66. The sliding channel 662 has a same curvature as that of the first sliding portion 463 of the second rail 40.

In assembly, the second rail 40 is received in the first rail 20, with the second sliding portions 445 and 465 slidably engaging with the recesses 244 and 264, respectively. Thus, the second rail 40 and the first rail 20 contact each other at arc surfaces 243 and 244, 263 and 264. The third rail 60 is slidably arranged between the side parts 44 and 46 of the second rail 40, with the first sliding portions 443 and 463 of the second rail 40 engaging with the sliding channels 642 and 662, respectively. Accordingly, the second rail 40 and the third rail 60 contact each other at arc surfaces 443 and 642, 463 and 662.

The slides of the slide rail contact each other at arc surfaces, which reduce the intensity of pressure applied on the slides. Accordingly, the slide rail is able to endure heavy loads. The arc contact surfaces can also be utilized in slide rails having only two slides, or four or more slides, as well.

It is believed that the present embodiments and their advantages will be understood from the foregoing description, and it will be apparent that various changes may be made thereto without departing from the spirit and scope of the description or sacrificing all of its material advantages, the examples hereinbefore described merely being exemplary embodiments.

What is claimed is:

1. A slide rail comprising:

a first rail comprising a main wall and two sidewalls symmetrically extending from two sides of the main wall;

a second rail slidably attached to the first rail and comprising a main body and two side parts symmetrically disposed on opposite sides of the main body, each of the side parts comprises a first deformed portion connected to the main body, a second deformed portion, a third deformed portion, and a fourth deformed portion connected end to end in that order, a first sliding portion formed on an outer surface of a corner between the first deformed portion and the second deformed portion, a second sliding portion formed on an outer surface of a corner between the third deformed portion and the fourth deformed portion; and a third rail slidably attached to the second rail;

wherein the first sliding portions of the second rail slidably engage with the third rail, the second sliding portions of the second rail slidably engage with the sidewalls of the first rail respectively.

2. The slide rail of claim 1, wherein the second rail further comprises a fifth deformed portion extended upward from a distal end of the fourth deformed portion, the first to fifth deformed portions form a C-shape.

3. The slide rail of claim 1, wherein the first rail comprises a main wall and two sidewalls symmetrically extending from opposite sides of the main wall, each sidewall defines an arc-shaped recess for receiving a corresponding second sliding portion of the second rail.

4. The slide rail of claim 3, wherein the curvature of the second sliding portion is the same as the curvature of the recess of the first rail.

5. The slide rail of claim 3, wherein each sidewall comprises an inclined portion slantingly connected a corresponding side of the main wall.

6. The slide rail of claim 1, wherein the two side parts are integrally extending from the main body.

7. The slide rail of claim 6, wherein the main body comprises two wing portions, a flat plate, and two connection portions slantingly connected between the wing portions and the flat plate, the wing portions are disposed on two sides of the flat plate, and parallel with the flat plate, which is parallel with the main wall of the first rail.

8. The slide rail of claim 7, wherein the connection portions slantingly connect the wing portions and opposite sides of the flat plate, respectively.

9. The slide rail of claim 7, wherein the wing portions are closer to the main wall of the first rail than the flat plate.

10. The slide rail of claim 1, wherein the third rail comprises an installation plate and two curved portions symmetrically disposed on two opposite longitudinal sides of the installation plate, each curved portion defines an arc-shaped sliding channel in an outer surface, the sliding channels slidably engages with the first sliding portions of the second rail respectively.

11. The slide rail of claim 10, wherein the sliding channel has a same curvature as the first sliding portion of the second rail.

12. A slide rail comprising:

a first rail comprising a main wall and two sidewalls symmetrically extending from two sides of the main wall, wherein each sidewall defines an arc-shaped recess;

a second rail slidably attached to the first rail and comprising a main body and two side parts symmetrically disposed on two sides of the main body, each of the side parts comprises a plurality of deformed portions, a first sliding portion formed on an outer surface of a corner between two adjacent deformed portions of the plurality of deformed portions, a second sliding portion formed on an outer surface of a corner between another two adjacent deformed portions, the first sliding portion opposite to the second sliding portion; and a third rail slidably attached to the second rail, the third rail comprising an installation plate and two curved portions symmetrically disposed on two sides of the installation plate respectively, an arc-shaped sliding channel is defined in an outer surface of each curved portion;

wherein the first sliding portions of the second rail are slidably received in the sliding channels of the third rail, the second sliding portions of the second rail are slidably received in the recesses of the first rail.

13. The slide rail of claim 12, wherein the curvature of the second sliding portions is the same as the curvature of the recesses of the first rail.

14. The slide rail of claim 12, wherein the sliding channel have a same curvature as the first sliding portions of the second rail.

15. The slide rail of claim 12, wherein each side part comprises a first deformed portion connected to the main body, a second deformed portion, a third deformed portion, a fourth deformed portion, and a fifth deformed portion connected in order, the first to fifth deformed portion form a generally C-shape.

16. The slide rail of claim 15, wherein the first sliding portion is arc-shaped and formed on an outer surface of a corner between the first deformed portion and the second deformed portion, the second sliding portion is arc-shaped and formed on an outer surface of a corner between the third deformed portion and the fourth deformed portion.

17. The slide rail of claim 15, wherein the main body comprises a flat plate, and two wing portions disposed on two sides of the flat plate, and parallel with the flat plate, the first deformed portion is acutely extended upward and away from the first rail, from the corresponding wing portion of the main body.

18. The slide rail of claim 17, wherein the second deformed portion is slantingly extended downward from a distal end of the first deformed portion, away from the first rail, the third deformed portion is slantingly extended downward from the second deformed portion, toward the first rail, the fourth deformed portion is slantingly extended upward from the third deformed portion, toward the first rail.

19. The slide rail of claim 17, wherein the wing portions are closer to the main wall of the first rail than the flat plate.

20. The slide rail of claim 1, wherein the first deformed portion extends toward the third rail from a side of the main body, the second deformed portion extends from a distal end of the first deformed portion to form an arc-shape together with the first deformed portion, the third deformed portion extends toward a corresponding sidewall of the first rail from an end of the second deformed portion opposite to the first deformed portion to form an arc-shape together with the second deformed portion, the fourth deformed portion extends toward the main wall of the first rail from an end of the third deformed portion opposite to the second deformed portion to form an arc-shape together with the third deformed portion.

* * * * *